United States Patent [19]

Maranci

[11] 4,081,498

[45] Mar. 28, 1978

[54] LUSTROUS, ANTISOILING FLAME RETARDANT ACRYLIC FIBERS AND PROCESS THEREFOR

[75] Inventor: Arutun Maranci, Westport, Conn.

[73] Assignee: American Cyanamid Company, Stamford, Conn.

[21] Appl. No.: 358,743

[22] Filed: May 9, 1973

[51] Int. Cl.[2] ..... C08L 33/20

[52] U.S. Cl. ..... 260/898; 260/895; 260/DIG. 24; 260/DIG. 32; 264/182

[58] Field of Search ..... 260/898, 895

[56] References Cited

U.S. PATENT DOCUMENTS

| | | | |
|---|---|---|---|
| 2,763,631 | 9/1956 | Coover et al. | 260/45.5 |
| 2,769,792 | 11/1956 | Ham | 260/32.6 |
| 3,288,888 | 11/1966 | Wieckowski | 260/898 |

*Primary Examiner*—Carman J. Seccuro
*Attorney, Agent, or Firm*—William J. van Loo

[57] ABSTRACT

Acrylic fibers of a fiber-forming first acrylonitrile polymer containing at least 50% acrylonitrile, a flame retardant amount of a halogen-containing vinyl monomer, and any balance of a halogen-free vinyl monomer having heterogeneously dispersed therein a small amount of an incompatible, halogen-free, second acrylonitrile polymer containing at least 70% acrylonitrile and one or more halogen-free vinyl monomers. The fibers are prepared by wet-spinning an intimate mixture of the polymers separately dissolved in aqueous inorganic solutions of the same salt following conventional procedures but including a hot-wet relaxation of the stretched wet-gel filaments prior to drying.

10 Claims, No Drawings

LUSTROUS, ANTISOILING FLAME RETARDANT ACRYLIC FIBERS AND PROCESS THEREFOR

This invention relates to highly lustrous flame retardant acrylic fibers having low apparent soiling tendencies. More particularly, the present invention relates to fibers based on a fiber-forming acrylonitrile copolymer containing an effective flame retardant amount of a compolymerized halogen-containing comonomer and having heterogeneously dispersed therein an incompatible acrylonitrile polymer free of any halogen-containing comonomer.

Acrylic fibers are generally spun into fiber by either dry or wet spinning procedures. In both procedures a fiber-forming acrylonitrile polymer is dissolved in a suitable solvent and spun. In dry spinning, the solvent is evaporated. In wet spinning the fiber is coagulated by a liquid non-solvent for the polymer. Dry spinning can be effected by means of an organic solvent only, while wet-spinning can be effected by means of organic or inorganic solvents.

It is well known that flame retardant acrylic fibers can be obtained from acrylonitrile copolymers containing halogenated monomers copolymerized therewith, such as vinyl chloride, vinyl bromide, vinylidene chloride, and the like. It is also known that suitable polymers of such type can be dissolved in inorganic solvents such as concentrated aqueous solutions of sodium thiocyanate, for example. Such polymer solutions may be extruded into aqueous coagulants to form filaments, which are then further processed into fiber.

Fibers obtained from such copolymers are particularly suitable for use in the fabrication of carpets, upholstery fabrics, and other home furnishings as a result of their flame retardancy. One deficiency of such fibers, however, is their undesirable tendency to exhibit soiling. The extent to which soiling is exhibited can be reduced by decreasing the light transmission of the fiber by incorporating within the fiber materials such as titanium dioxide and other uncolored opacifying materials. Unfortunately, this approach results in dull, delustered fiber which is unacceptable in many uses for which it is provided.

In accordance with the present invention, there is provided a highly lustrous, flame retardant acrylic fiber of low apparent soiling tendencies which comprises a first acrylonitrile polymer containing at least 50 weight percent acrylonitrile, an amount of a halogen-containing vinyl monomer sufficient to impart flame retardancy to said fiber, and any balance of a halogen-free monomer, and, heterogeneously dispersed within said first polymer, a second acrylonitrile polymer free from any halogen content and containing at least 70 weight percent acrylonitrile and any balance of one or more halogen-free vinyl monomers, said second polymer being incompatible with said first polymer and being present in an amount of about 2 to 15 weight percent based on the total weight of said first and said second polymers.

There is also provided the process for preparing the above fiber which process comprises the steps of: (a) preparing a first solution in an aqueous inorganic solvent of a fiber-forming first acrylonitrile polymer containing at least 50 weight percent acrylonitrile, a flame-retardant halogen-containing vinyl monomer in an amount sufficient to impart flame retardancy to said fiber, and any balance of a halogen-free vinyl monomer;

(b) preparing a second solution in an aqueous solvent of the same inorganic salt used in step (a) of a second acrylonitrile polymer free from halogen content and incompatible with said first polymer, said second polymer containing at least 70 weight percent acrylonitrile and any balance of one or more halogen-free vinyl monomers; (c) intimately mixing said second solution in said first solution so as to form a spinning composition in which the polymer content is 98 to 85 weight percent of said first polymer and, correspondingly, 2 to 15 weight percent of said second polymer, said percentages totaling 100; (d) extruding said spinning composition into an aqueous coagulant to form wet-gel filaments; (e) washing the wet-gel filaments free of solvent; (f) stretching the washed wet-gel filaments to provide suitable orientation; (g) relaxing the stretched wet-gel filaments under hot-wet conditions; and thereafter drying the relaxed filaments.

In accordance with the present invention, the provision for small amounts of a halogen-free polymer within the fiber-forming halogen-containing polymer with which it is incompatible coupled with the provision for relaxation of the stretched wet-gel filaments prior to drying results in an flame-retardant acrylic fiber having high luster and low light transmission. The latter property provides a desirable low level of apparent soiling tendencies in the resulting fiber. These results are highly surprising and totally unexpected in view of the fact that use of a major amount of halogen-free polymer with a minor amount of a halogen-containing polymer in admixture in aqueous inorganic solvent results in a gelled mixture which is incapable of being extruded into filaments. It is also surprising that omission of the step of relaxing the wet gel filaments does not result in the desired fiber optical properties.

The halogen-containing acrylonitrile polymer is the fiber-forming polymer of the present invention and is referred to as the first polymer. This polymer must contain at least 50 weight percent acrylonitrile and sufficient of a halogen-containing vinyl monomer to provide a flame retardant fiber. It may also contain one or more halogen-free monomers in order to make up a fiber-forming acrylonitrile polymer of desired properties. The content of halogen-containing monomer may vary from about 5 to 30 weight percent and is generally selected on the basis of the degree of flame retardance desired. Suitable flame retardance halogen-containing monomers are exemplified by vinyl chloride, vinyl bromide, vinylidene chloride, vinylidene bromide, and the like, as well as mixtures thereof. Suitable halogen-free monomers are exemplified by mono-olefinic monomers such as the acrylate and methacrylate esters such as the methyl, ethyl, butyl, and methoxymethyl esters; the corresponding alkyl derivatives of acrylamide and methacrylamide; methacrylonitrile; methyl vinyl ketone; vinyl carboxylates, such as vinyl acetate, vinyl formate, vinyl propionate, and vinyl stearate; N-vinylimides, such as N-vinylphthalimide and N-vinylsuccinimide; methylene malonic esters, itaconic acid and esters thereof; N-vinylcarbazole; vinyl furan; alkyl vinyl ethers; vinyl sulfonic acids, such as vinyl sulfonic acid, styrene sulfonic acid, methallyl sulfonic acid, p-methallyloxybenzene sulfonic acid and salts thereof; ethylene alpha, beta-dicarboxylic acid esters such as diethyl citraconate, diethyl mesaconate as well as, the free acids and other derivatives thereof; styrene; vinylnaphthalene; vinyl-substituted tertiary heterocyclic amines such as the vinylpyridines and alkyl-substituted vinylpyridines, such as 2-vinylpyridine, 4-vinylpyridine, 2-methyl-5-vinylpyridine, and the like; 1-vinylimidazoles, such as 2-, 4-, or 5-methyl-1-vinylimidazole, vinylpyrrolidone, vinylpiperidone; and other mono-olefinic copolymerizable monomers.

The halogen-free acrylonitrile polymer, which is incompatible with the first acrylonitrile polymer but is heterogeneously dispersed therein must contain at least 70 weight percent acrylonitrile and any balance, i.e. up to 30 weight percent of at least one of the halogen-free monomers described hereinabove. The halogen-free acrylonitrile polymer is referred to as the second acrylonitrile polymer.

The two polymers thus described must be separately soluble in the aqueous inorganic solvent to be employed in fiber spinning. Solubility should be at least about 8 weight percent of polymer in 92 weight percent of the solvent. Preferably, solubility will be in the range of 10 to 20 weight percent of polymer in, correspondingly 90 to 80 weight percent of solvent, but even higher solubility is possible. The various useful solvents are the various aqueous solutions that are conventional and include concentrated aqueous solutions of such salts as zinc chloride, sodium thiocyanate, calcium thiocyanate, lithium bromide and the like, as well as various salt mixtures. The salt mixtures include salts which individually in concentrated aqueous solutions dissolve the polymer and salts which individually in concentrated aqueous solutions do not dissolve the polymer. Such salts, in admixture such that at least one polymer-dissolving salt is present, are more effective polymer solvents than the single salts in solution. These various salts and admixture are disclosed in various references including the following U.S. Pat. Nos. 2,140,921; 2,425,192; 2,648,592; 2,648,593; 2,648,648; and 2,648,649. Advantageously, sodium thiocyanate is employed as the polymer solvent at a concentration of 40 to 60 weight percent in water.

In carrying out the process of the present invention, the first acrylonitrile polymer is dissolved in an aqueous inorganic solvent in a polymer concentration of at least 8 weight percent.

A separate solution of the second polymer is then prepared using an aqueous solvent of the same inorganic salt. The second polymer, which need not be a fiber-forming polymer, is employed in solution in an amount which preferably provides a solution viscosity which closely matches that of the solution of the first polymer so as to aid in obtaining an intimate mixture. The concentration of the second polymer in weight percent in solution is not critical so long as the viscosity relationship is maintained and the addition of the appropriate quantity of the solution of the second polymer does not reduce the total polymer content of the mixed solution below about 8 weight percent.

According to the present invention, sufficient of the solution of the second polymer is intimately mixed with the solution of the first polymer to provide from about 2 to 15 weight percent of the second polymer based on the total weight of polymer present, i.e. 98 to 85 weight percent of the first polymer will also be present so that the amounts of both polymers will total 100 weight percent. Because of the incompatibility of the two polymers, a dispersion will result which should be extruded while in intimate mixture. The dispersion is spun into aqueous coagulant, generally an aqueous solution of the solvent salt or salts at lower concentration, i.e. 10 to 15 weight percent in water, the coagulant being maintained at a temperature below about 15° C. Wet gel filaments result by diffusion of the coagulant into the extruded filaments and by the resulting dilution of the solvent concentration. The thus formed filaments are continuously withdrawn from the coagulant, washed with water to remove residual salt, and then stretched in hot water, generally at 95° C. or higher to impart orientation and strength associated therewith. Stretching is generally at a stretch ratio of about 6 to 14, preferably about 8 to 12. The stretched wet-gel filaments are then subjected to relaxation by placing them in a hot-wet atmosphere in a free-to-shrink state. The relaxing atmosphere may be hot water, super-heated water or steam under pressure, atmospheric steam or other hot-wet shrinking medium. It is critical that this relaxation step be carried out on the stretched wet gel filaments prior to any drying if the results of the present invention are to be achieved. When steam is employed as the relaxing medium, the temperature is generally in the range of about 100° to 140° C. depending upon the extent to which shrinking is desired. As shrinkage will occur during relaxation, the desired fiber properties can be achieved by controlling the stretch ratio and relaxation temperature.

After the required relaxation of the wet gel filaments has been carried out, the filaments are then dried in hot air.

Although in certain prior art procedures wet gel relaxation is carried out prior to drying the filaments, most procedures do not have the criticality associated with the particular order of steps as does the present process. The combination of blending small portions of the second polymer solution with the first polymer solution followed by conventional wet spinning including the wet gel relaxation of the stretched filaments prior to drying provides flame retardant acrylic fibers of high luster and desirably low apparent soiling properties, the latter being distinguished by low light transmission properties.

The invention is more fully illustrated by the examples which follow in which all parts and percentages are by weight unless otherwise specifically designated. In the examples which follow, reference is made to fiber luster and light transmission. In order that these terms may be understood, the following definitions and testing procedures are given.

LUSTER

Luster, though a real and important optical property, is complex and difficult to define concisely. One generally accepted definition describes luster as the differences in the amount and quality of light reflected at various angles of incidence. The amount of light reflected by fibers at the angles of greatest and least reflectance is measured against a standard reflectance source. The ratio of the highest reflectance divided by the lowest reflectance is a measure of the luster of the sample.

A test sample is prepared by winding the filaments on a flat plate under tension. The sample is placed in a Color-Eye® (Model C, manufactured by Instrument Developement Laboratories) suitably equipped with a device for rotating the sample and a calibrated vitrolite standard. The intensity of the light reflected is measured against the standard on the Y setting. The sample is rotated slowly until the least amount of light is reflected ($Y_2$) and then until the most amount of light is reflected ($Y_1$). The percent luster is calculated by the following formula:

$$\% \text{ Luster} = ((Y_1 - Y_2) \times 100/Y_2).$$

However, for comparison purposes, it is only necessary to know the difference between $Y_1$ and $Y_2$ to get a meaningful measure of luster, higher values of the difference generally indicating higher fiber luster. This procedure is followed in the examples which follow.

LIGHT TRANSMISSION

Fine structure in fibers due to interfaces or inclusions tends to scatter light, thus reducing the transmission of light through the fibers. When such a structure is surface related or connected, the fibers are delustered. When, however, as in the case of the present invention, the structure is totally internal and of a certain size and shape, significant reductions in light transmission can be obtained without significant loss in luster, and, in many cases such reductions in light transmission are possible with increase in luster over comparable fibers not having such structure. When fiber is immersed in a liquid of similar refractive index, surface scattering of light such as that due to geometric factors, is eliminated and scattering which occurs can be assigned to the effect of internal scattering. In turn, scattered, light is not transmitted through the fiber so that a measurement of relative light transmission of fiber immersed in an appropriate liquid can be considered a measure of its apparent soiling tendencies.

To determine light transmission, finely cut fiber is dispersed in a liquid of similar density and refractive index (in this case, dimethyl phthalate). The sample is placed in the light beam of a photometer calibrated to 100% light transmission for the liquid alone. Percent light transmission of the fiber-liquid dispersion is then determined. Normally, a fiber-liquid dispersion of 0.125 grams of fiber cut to less than ⅛ inch length in 25 milliliters of liquid is used. The average value of repeated determinations is reported. For desirably low apparent soiling properties, light transmissions of less than about 25%, preferably less than 20% are desired. In the examples which follow, the desired low degrees of light transmission are below 25% while undesirable high degrees are higher than 25%, usually much higher.

Comparative Example A

A spinning solution was prepared containing 10% of a fiber-forming polymer of composition 81.1% acrylonitrile 9.2% methyl methacrylate, and 9.7% vinylidene chloride in 90% of an aqueous solution of 46% sodium thiocyanate. The solution had a viscosity of 34 poises at 28° C. and was extruded through a spinnerette having 10 orifices, each of 200 microns diameter, into an aqueous 12% sodium thiocyanate solution maintained at −2° C., to form filaments. The filaments were continuosly withdrawn from the bath, stretched at a stretch ratio of 2, washed with water, and drawn a second time in water at 99° C. so as to provide a cumulative stretch ratio of 12 and a denier of 9.6.

The stretched filaments were dried in a free-to-relax state at 127° C. dry bulb and 60° C. wet bulb and then further relaxed in saturated steam at 130° C. The filaments obtained had a high degree of luster and a high degree of light transmission, indicating that the filaments had an undesirabily high level of apparent soiling tendencies.

Comparative Example B

A portion of the wet-stretched filaments of comparative Example A, prior to drying were first exposed to saturated steam at 110° C. in a free-to-relax state for 10 minutes and thereafter dried at 100° C. dry bulb and 36° C. wet bulb. The filaments obtained were highly delustered but had a very low light transmission, thus indicating that the apparent soiling tendencies were low but the luster value of 9.2 was unsatisfactory.

EXAMPLE 1

A solution of 11.2% of a polymer having a composition of 89.3% acrylonitrile and 10.7% methyl methacrylate, was prepared in 88.8% of an aqueous solution of 40% sodium thiocyanate. Five parts of this solution were mixed with 95 parts of the solution used in Comparative Example A. The mixed solution was turbid, thus indicating incompatibility between the two solutions. The mixed solution was spinnable, however, and stretched wet gel filaments were made following the procedure of Comparative Example A.

The wet-stretched filaments were then exposed to saturated steam and dried as in Comparative Example B. The filaments obtained had a high degree of luster, 19.8%, and a low degree of light transmission, indicating low apparent soiling tendencies.

EXAMPLE 2

The procedure of Example 1 was followed in every material detail except that 10 parts of the solution of Example 1 were mixed with 90 parts of the solution of Comparative Example A. The resulting fiber had a low degree of light transmission, thus indicating a desirably low apparent soiling tendency, and a high degree of luster, 17.5%.

In addition to the light transmission and luster properties reported in the examples above, the fiber obtained in each of the examples had a desirable level of flame retardancy when tested according to standard procedures.

EXAMPLE 3

The procedure of Example 2 is followed in every material detail except that the fiber-forming polymer contains 65% acrylonitrile, 15% methyl methacrylate, and 25% vinyl chloride. The solvent is an aqueous solution of 60% sodium thiocyanate. The fiber obtained has a high degree of luster and a desirably low apparent soiling tendency, as well as outstanding flame retardancy.

I claim:

1. A flame retardant acrylic fiber having a luster value of at least about 17.5% and a light transmission of less than about 25% which comprises a first fiber-forming acrylonitrile polymer containing at least 50 weight percent acrylonitrile, an amount of a halogen-containing vinyl monomer sufficient to impart flame retardancy to said fiber, and any balance of a halogen-free vinyl monomer, and heterogeneously dispersed within said first polymer, a second acrylonitrile polymer free from any halogen content and containing at least 70 weight percent acrylonitrile and any balance of one or more halogen-free vinyl monomers, said second polymer being incompatible with said first polymer and being present in an amount of about 2 to 15 weight percent based on the total weight of said first and second polymers.

2. The fiber of claim 1 wherein said first polymer contains from about 5 to 30 weight percent of a halogen-containing monomer.

3. The fiber of claim 1 wherein said halogen-containing vinyl monomer is vinylidene chloride.

4. The fiber of claim 1 wherein said first polymer contains 81.1% acrylonitrile, 9.2% methyl methacrylate, and 9.7% vinylidene chloride.

5. The fiber of claim 4 wherein said second polymer contains 89.3% acrylonitrile and 10.7% methyl methacrylate.

6. A process for preparing a flame retardant acrylic fiber having a luster value of at least about 17.5% and a light transmission of less than about 25% which comprises the steps of: (a) preparing a first solution in an aqueous inorganic salt solvent of a fiber-forming first acrylonitrile polymer containing at least 50 weight percent acrylonitrile, a flame retardant, halogen-containing vinyl monomer in an amount sufficient to impart flame retardancy to said fiber and any balance of a halogen-free vinyl monomer; (b) preparing a second solution in an aqueous solvent of the same inorganic salt used in step (a) of a second acrylonitrile polymer free from any halogen content and incompatible with said first polymer, said second polymer containing at least 70 weight acrylonitrile and any balance of one or more halogen-free vinyl monomers; (c) intimately mixing said second solution in said first solution so as to form a spinning composition in which the polymer content is 98 to 85 weight percent of said first polymer and, correspondingly 2 to 15 weight percent of said second polymer, said percentages totaling 100; (d) extruding said spinning composition into an aqueous coagulant to form wet-gel filaments; (e) washing the wet-gel filaments free of solvent; (f) stretching the washed wet-gel filaments to provide suitable orientation; (g) relaxing the stretched wet-gel filaments under hot-wet conditions; and thereafter drying the relaxed filaments.

7. The process of claim 6 wherein the aqueous inorganic solvent is a 40–60 weight percent aqueous solution of sodium thiocyanate.

8. The process of claim 6 wherein step (f) is carried out at a stretch ratio of 6 to 14.

9. The process of claim 6 wherein step (g) is carried out in saturated steam at 110° C. for 10 minutes.

10. The process of claim 6 wherein drying is at a dry bulb temperature of 100° C. and a wet bulb temperature of 36° C.

* * * * *